US010857442B2

(12) United States Patent
Kibbe et al.

(10) Patent No.: US 10,857,442 B2
(45) Date of Patent: Dec. 8, 2020

(54) BASEBALL SWING TRAINING DEVICE

(71) Applicant: MAGIC SPORTS, LLC, Ames, IA (US)

(72) Inventors: Robert Nicholas Kibbe, Ames, IA (US); Grant David Roepsch, Cozard, NE (US); Aaron Matthew Tjaden, Cedar Rapids, IA (US); Ryan Patrick McGuire, Ames, IA (US)

(73) Assignee: Magic Sports, LLC, Ames, IA (US)

( * ) Notice: Subject to any disclaimer, the term of this patent is extended or adjusted under 35 U.S.C. 154(b) by 0 days.

(21) Appl. No.: 16/273,915

(22) Filed: Feb. 12, 2019

(65) Prior Publication Data

US 2019/0282876 A1 Sep. 19, 2019

Related U.S. Application Data

(60) Provisional application No. 62/643,566, filed on Mar. 15, 2018.

(51) Int. Cl.

| | |
|---|---|
| ***A63B 71/00*** | (2006.01) |
| ***A63B 69/00*** | (2006.01) |
| *A63B 69/40* | (2006.01) |
| *A63B 71/02* | (2006.01) |

(52) U.S. Cl.

CPC ..... *A63B 69/0075* (2013.01); *A63B 69/0002* (2013.01); *A63B 69/0079* (2013.01); *A63B 2069/0008* (2013.01); *A63B 2069/401* (2013.01); *A63B 2071/026* (2013.01); *A63B 2225/093* (2013.01)

(58) Field of Classification Search

CPC ..... A63B 69/0075; A63B 69/0095; A63B 2069/0077; A63B 69/0002; A63B 69/0079; A63B 2069/0008; A63B 2069/401; A63B 2071/026; A63B 2225/093

USPC ..... 473/418, 422, 451, 417

See application file for complete search history.

(56) References Cited

U.S. PATENT DOCUMENTS

| | | | | |
|---|---|---|---|---|
| 2,377,010 A * | 5/1945 | Howard | F16L 33/213 285/148.13 |
| 3,425,700 A * | 2/1969 | Edwards | A63B 69/0079 473/147 |
| 3,940,132 A * | 2/1976 | Lopatto, III | A63B 69/0075 473/418 |

(Continued)

FOREIGN PATENT DOCUMENTS

| | | | |
|---|---|---|---|
| FR | 2232339 A1 * | 1/1975 | A63B 69/0091 |

OTHER PUBLICATIONS

International Searching Authority, "Notification of Transmittal of The International Search Report and the Written Opinion of the International Searching Authority", for PCT/US2019/022450, dated Jun. 20, 2019, 7 pages.

*Primary Examiner* — Mitra Aryanpour

(74) *Attorney, Agent, or Firm* — Zarley Law Firm, P.L.C.

(57) ABSTRACT

A baseball swing training device has a base, a support member adjustably connected to the base, and a suction assembly disposed in the base that extends through and out of the support member to hold a ball in a stationary position. The suction assembly includes a coil vacuum hose disposed within the support member, and connected to a vacuum pump assembly, and an elongated hose connected to the coil vacuum hose at one end, and removeably connected to a suction nozzle at an opposite end.

12 Claims, 5 Drawing Sheets

(56) References Cited

U.S. PATENT DOCUMENTS 4,161,313 A * 7/1979 Dickey ..... A63B 69/0071 473/449
4,191,372 A * 3/1980 Keller ..... A63B 69/38 473/418
4,352,494 A * 10/1982 Wells ..... A63B 69/0075 473/449
5,286,241 A * 2/1994 Petrakis ..... A63B 69/205 482/83
5,586,360 A * 12/1996 Diederiks, Jr. ..... A47L 9/02 15/410
6,443,859 B1 * 9/2002 Markin ..... A63B 69/406 473/451
6,766,560 B2 * 7/2004 Murphy ..... A47L 5/14 15/344
6,790,150 B1 * 9/2004 Moss ..... A63B 69/0079 473/423
7,980,966 B2 7/2011 Tell et al.
8,425,352 B1 4/2013 Loduca et al.
8,739,362 B1 * 6/2014 Conder ..... E04D 13/0765 15/406
8,900,075 B2 * 12/2014 Gu ..... A63B 69/0002 473/422
9,352,204 B2 5/2016 Gardner et al.
10,118,080 B2 * 11/2018 Loduca ..... G09B 19/0038 473/451
10,405,712 B2 * 9/2019 Collar ..... A47L 9/248 15/320
2001/0047183 A1 * 11/2001 Privitera ..... A61B 10/0275 606/170
2003/0064836 A1 * 4/2003 Moss ..... A63B 69/0079 473/417
2004/0009832 A1 * 1/2004 Matulek ..... A63B 69/0002 473/429
2004/0017083 A1 * 1/2004 Balamuta ..... F04B 39/123 285/390
2004/0143931 A1 * 7/2004 Dennis ..... A47L 5/14 15/414
2004/0177469 A1 * 9/2004 Sadaune ..... A47L 9/08 15/322
2005/0003908 A1 1/2005 Smull et al.
2007/0167297 A1 * 7/2007 Stevenson ..... A63B 69/24 482/83
2008/0053452 A1 * 3/2008 Brown ..... A63B 21/00196 128/207.12
2009/0082140 A1 * 3/2009 Liao ..... A63B 69/0002 473/417
2010/0078536 A1 * 4/2010 Galvin ..... F16M 11/40 248/231.51
2010/0304900 A1 12/2010 Gu
2011/0132405 A1 * 6/2011 Lowenstein ..... B08B 5/04 134/21
2011/0221219 A1 * 9/2011 Heaton ..... A63B 47/02 294/210
2013/0085020 A1 4/2013 Loduca et al.
2015/0343289 A1 12/2015 Gardner et al.
2018/0369673 A1 * 12/2018 Flora ..... A63B 69/0075 473/451

* cited by examiner

BASEBALL SWING TRAINING DEVICE

CROSS REFERENCE TO RELATED APPLICATION

This application claims the benefit of U.S. Provisional Application No. 62/643,566 filed Mar. 15, 2018, the contents of this application is hereby incorporated by reference in its entirety.

BACKGROUND OF THE INVENTION

The present invention is directed to a baseball swing training device. More particularly, the present invention is directed to a baseball swing training device that assists in developing proper swing mechanics.

Devices for developing baseball swings are known in the art. Most common is a baseball tee having a base, a vertical shaft that extends vertically from the base, and a support connected to the top of the shaft to receive and support a ball. These batting tees encourage poor swing mechanics. Because the ball sits on top of the tee, a proper swing, where the ball is struck on a lower portion, is impeded by the bat making contact with the shaft of the tee.

Other devices, where the ball is hung from above do not solve this problem. In one example, in order to hold the ball, the device has a retaining member that covers at least half the ball, restricting visibility of the upper portion of the ball. Another device that uses vacuum pressure is designed to move the ball through a hitting zone to develop hand eye coordination and not swing mechanics.

Ideal swing mechanics involve hitting the ball on the bottom third portion with a range of an approximately seventeen to thirty-five degree launch angle. Needed in the art is a swing training device where the ball is almost completely visible to encourage proper swing mechanics where the bottom of the ball is unimpeded by the tee and allows the ball to be cleanly hit, driving through the ball with a more mechanically sound swing by providing an almost completely visible stationary target. Through repetition, one develops muscle training and muscle memory for proper swing mechanics.

An objective of the present invention is to provide a baseball swing training device where the ball is stationary and almost completely visible.

Another objective of the present invention is to provide a baseball swing training device that develops proper swing mechanics.

These and other objectives will be apparent to one having ordinary skill in the art based on the following written description, drawings and claims.

SUMMARY OF THE INVENTION

A baseball swing training device achieves the stated objectives by suspending a ball with vacuum pressure in a near completely visible manner, naturally encouraging better batting swing mechanics where a batter is more likely to cleanly hit the bottom of the ball, driving through it in a more mechanically sound swing.

Visibly found in other training devices are solved via a self-contained system that provides a constant source of vacuum suction to suspend the ball. The constant source of optimal amount of vacuum pressure permits use of a minimal contact patch or suction cup to connect the ball to the suction assembly. This arrangement permits the ball to be almost completely visible to the user giving them a more realistic view of the ball.

The device is also portable having a base having a housing that enclose a battery and a vacuum pump assembly. An adjustable support member is connected to the base and a suction assembly extends from the base through the support member. The suction assembly includes a coil vacuum hose connected to the vacuum pump assembly at one end and an elongated vacuum hose at the opposite end. The elongated vacuum hose is connected to a suction nozzle that extends out of the support member and holds a ball with suction pressure.

DETAILED DESCRIPTION OF THE PREFERRED EMBODIMENTS

Figure 1:
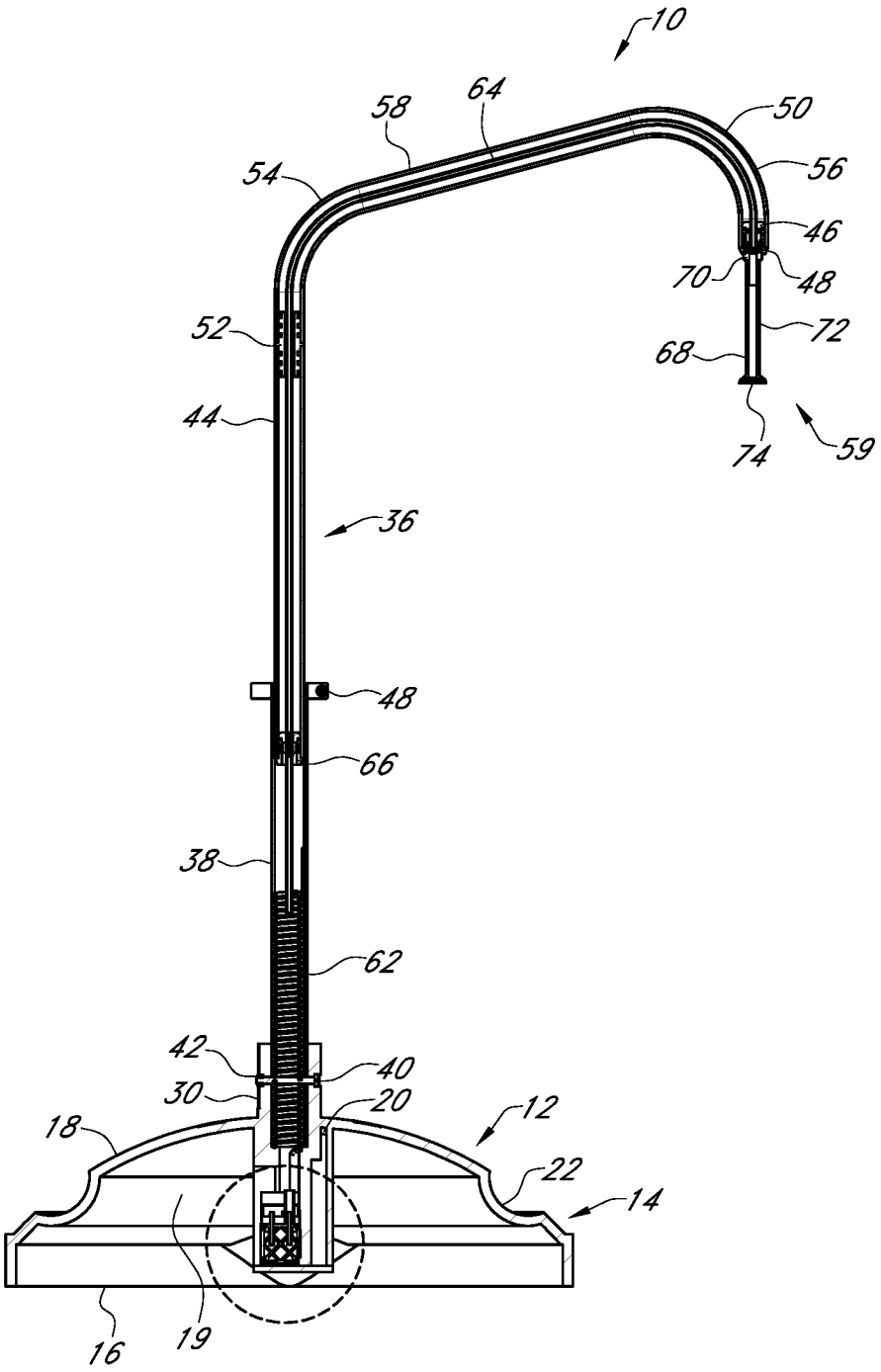
FIG. 1 is a side sectional view of a baseball swing training assembly.
Figure 2:
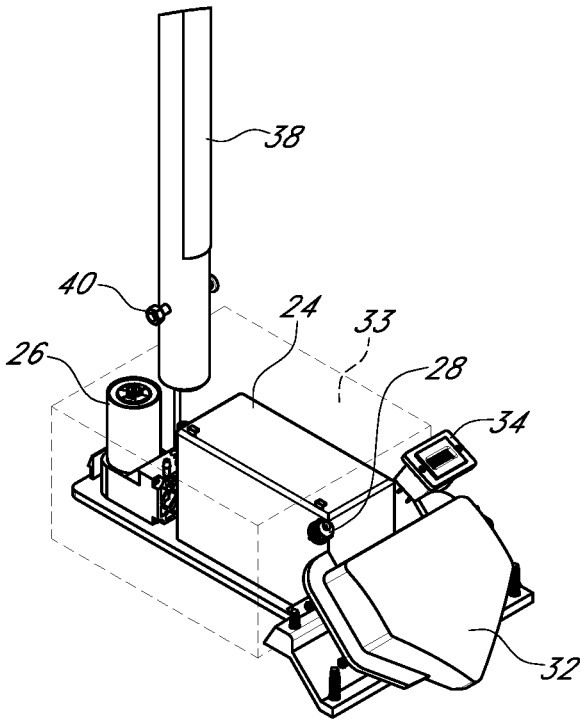
FIG. 2 is a perspective view of a portion of a baseball swing training device.
Figure 3:
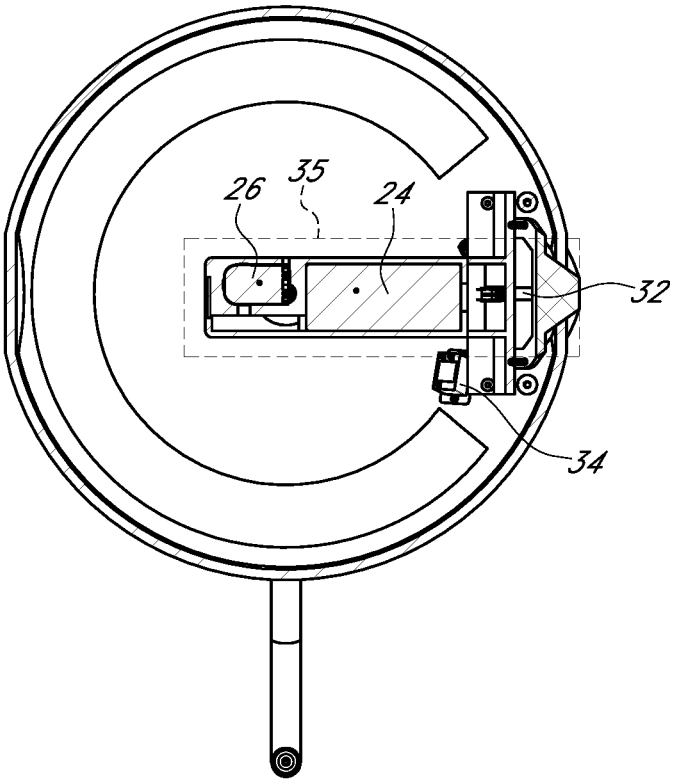
FIG. 3 is a bottom plan sectional view of a baseball swing training device.
Figure 4:
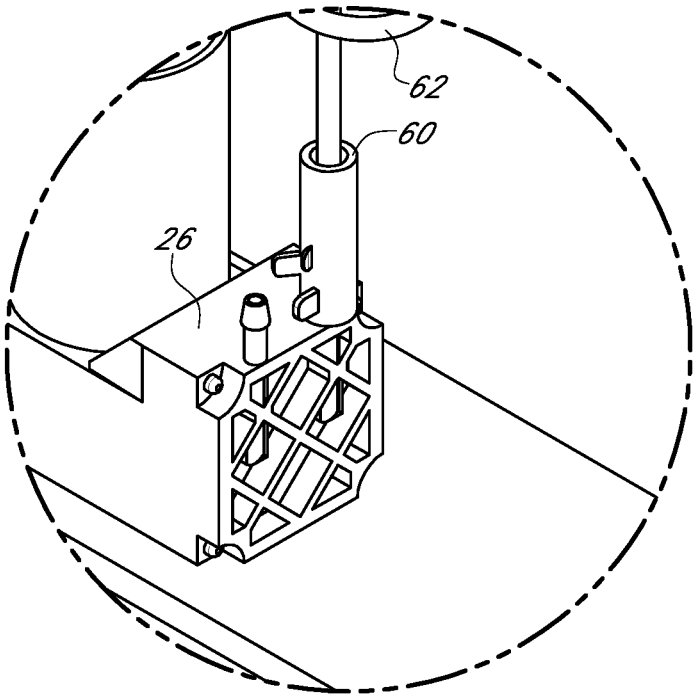
FIG. 4 is a perspective view of a portion of a suction assembly for a baseball swing training device.
Figure 5:
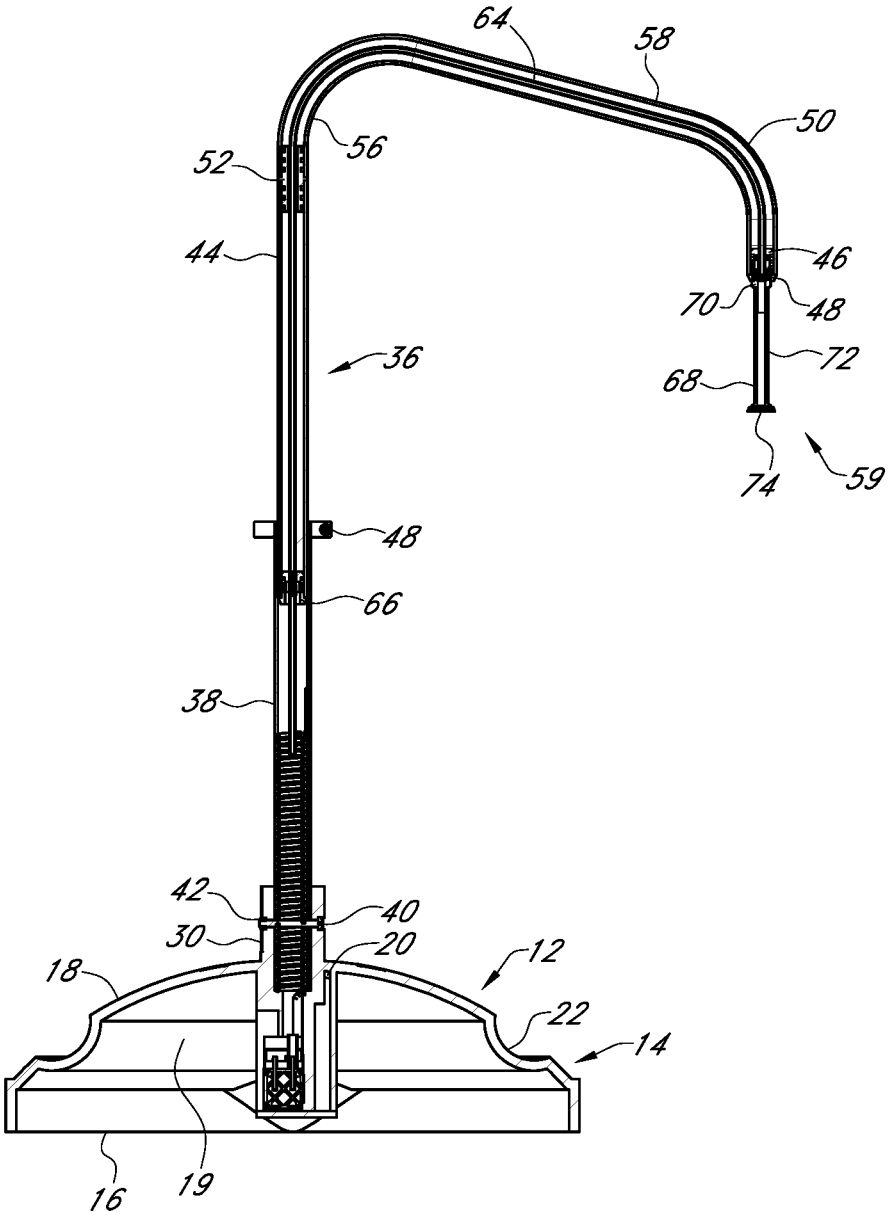
FIG. 5 is a side sectional view of a baseball swing training assembly with a first curved portion and a second curved portion in reverse position.

Referring to the Figures, a baseball swing training device 10 has a base 12. The base 12 includes housing 14. While the housing 14 is of any size, shape, and structure, preferred is a housing 14 having a circular bottom section 16 and a generally conical section 18 that form a hollow chamber 19. The cover section 18 has a central opening 20 and a groove 22 that extends horizontally at least partially around the outer surface of the cover section 18. The groove 22 is formed and adapted to receive a plurality of balls such as baseballs, softballs or the like. The cover section 18 is made of any material and preferably a rubber polymer blend.

Disposed within the housing 14 is a battery 24 connected to a vacuum pump assembly 26. Preferably, the battery 24 is connected to a battery charger barrel plug 28 that extends through the cover section 18 for connection to a power source to recharge the battery 24. A connection tube or collar 30 extends through the central opening 20 of the cover section 18. Also, connected to the battery 24 through the cover section 18 is an activating device 32 such as a switch plate or the like. A battery meter 34 and/or an indicator light are also connected to the battery 24 through the cover section 18. The battery 24 and vacuum pump assembly 26 are disposed within an inner housing 33 having a removable cover plate 35 on the circular bottom section 16 of housing 14.

Attached to the connection collar 30 is a support member 36. The support member 36 is of any size, shape, and structure, and preferably is comprised by a number of hollow tubes connected together. In one example, a first or bottom tube 38 is connected to the connection collar 30. A bolt 40 and nylon insert nut 42 may be used to secure the connection. A second or middle tube 44 is slidably connected to the first tube 38 and locked into place with a shaft locking collar clamp 48. Finally, a third or top tube 50 is connected to the second tube 44.

The third tube 50 preferably is made of three pieces including a first curved end piece 54, a second curved end piece 56, and an elongate piece 58 that extends between the two ends 54 and 56. The two ends 54 and 56 are curved at different angles, preferably one at 45 to 60 degrees and the other at approximately 120 degrees, and both can be connected to the middle tube 44. This permits the device to be easily adjusted between a low and a high hitting position.

Extending through and out of the support member 36 is a suction assembly 59. The suction assembly 59 includes a tube 60 that connects the vacuum pump assembly 26 to a coil vacuum hose 62. The coil vacuum hose 62 is disposed within the first tube 38 and is made of a material and has the necessary diameter to carry a required vacuum pressure when adjusted to prevent the hose 62 from collapsing. The coil vacuum hose 62 is connected to an elongated hose 64 preferably with a push union fitting 66. The elongated hose 64 extends through the support member 36 to the end 54 or 56 of the third tube 50 opposite to the second tube 44 where hose 64 is connected to a suction nozzle 68. The hose 64 preferably is connected to the suction nozzle 68 using an insert plug 46, a hose barb to female, and a push fitting 70. While the suction nozzle 68 is of different shapes and structures, preferred is that the nozzle 68 have an elongated shaft 72 that terminates in a suction cup 74. The suction cup 74 has a diameter that covers only a small portion of the ball leaving the majority of the top portion of a connected ball uncovered. In general the suction cup 74 covers less that twenty-five percent of the surface of the ball and preferably about 2 to 4 percent for a softball (which is available in multiple sizes depending upon how and where used) and about 3 to 5 percent of a standard baseball.

In operation, the height of the training device is adjusted to a desired height by sliding the middle tube 44 up or down in relation to the first tube 38 and securing the position with shaft locking collar 48 and/or reversing ends 54 and 56 of the third tube 50 as it is connected to the second tube 44. Once positioned, the activating device 32 is engaged and the battery 24 provides electrical power to the vacuum pump assembly 26. The vacuum pump assembly 26 provides suction throughout the suction assembly 59 from the coil vacuum hose 62 to the elongated hose 64 and finally to the suction nozzle 68. The amount of suction provided is enough to hold the ball when one taps on the ball in a stationary position, but release the ball when one slaps the ball. Preferably, the amount of suction is between 12 and 16 inches of mercury per vacuum. Accordingly, a baseball swing training device has been disclosed that at the very least, meets all the stated objectives.

From the above discussion and accompanying figures and claims it will be appreciated that the baseball swing training device 10 offers many advantages over the prior art. It will be appreciated further by those skilled in the art that various other modifications could be made to the device without parting from the spirit and scope of this invention. All such modifications and changes fall within the scope of the claims and are intended to be covered thereby. It should be understood that the examples and embodiments described herein are for illustrative purposes only and that various modifications or changes in the light thereof will be suggested to persons skilled in the art and are to be included in the spirit and purview of this application.

What is claimed is:

1. A baseball swing training device, comprising:

a support member connected to a base;

the support member having a top tube;

the top tube having a first curved portion, a second curved portion, and an elongated portion between the first curved portion and the second curved portion; wherein the first curved portion is curved at an angle that is different from an angle of the second curved portion such that a height of the support member is adjustable by reversing the position of the first curved portion with the second curved portion, wherein the top tube is configured to be releasable and reversible with respect to the support member; and a suction assembly disposed within the base, extending through the support member and adapted to hold a ball in a stationary position.

2. The device of claim 1 wherein the suction assembly has a suction nozzle adapted to hold the ball with a majority of a top portion of the ball uncovered.

3. The device of claim 1 wherein a battery and a vacuum pump assembly are disposed within a housing of the base.

4. The device of claim 1 wherein an activation device is connected to the base.

5. The device of claim 1 where the base has a housing with a groove that extends horizontally at least partially around the outer surface of the housing, and is adapted to receive a plurality of balls.

6. The device of claim 1 wherein the support member includes a plurality of hollow tubes connected together.

7. The device of claim 6 with a first tube adjustably connected to a connection tube that extend out of the base.

8. The device of claim 1 wherein the suction assembly includes a coil vacuum hose connected to a vacuum pump assembly.

9. The device of claim 8 further comprising an elongated hose connected to the coil vacuum hose at one end and is removeably connected to a suction nozzle at an opposite end.

10. The device of claim 9 wherein the suction nozzle has an elongated shaft that terminates in a suction cup.

11. The device of claim 1 wherein the first curved portion is angled at an angle between 45 to 60 degrees.

12. The device of claim 11 wherein the second curved portion is angled at an angle of approximately 120 degrees.

* * * * *